US005894199A

United States Patent [19]

Pasco

[11] Patent Number: 5,894,199

[45] Date of Patent: Apr. 13, 1999

[54] TERTIARY FIELD TUNING OF POSITIVE ANODE MAGNETRON

[75] Inventor: Richard J. Pasco, Williamsport, Pa.

[73] Assignee: Litton Systems, Inc., Woodland Hills, Calif.

[21] Appl. No.: 08/797,694

[22] Filed: Jan. 31, 1997

[51] Int. Cl.[6] ..... H01J 23/213; H01J 25/50

[52] U.S. Cl. ..... 315/39.55; 315/39.71; 331/90

[58] Field of Search ..... 315/39.55, 39.57, 315/39.59, 39.71, 39.51; 331/90

[56] References Cited

U.S. PATENT DOCUMENTS

| | | | |
|---|---|---|---|
| 2,251,002 | 7/1941 | Rice et al. | 315/39.51 X |
| 2,504,187 | 4/1950 | Derby | 315/39.57 |
| 2,939,046 | 5/1960 | Wilbur | 315/39.71 |
| 2,940,007 | 6/1960 | Thal, Jr. | 315/39.55 |
| 3,334,267 | 8/1967 | Plumridge | 315/39.59 X |
| 4,104,559 | 8/1978 | Hobbs | 315/39.51 |
| 5,422,542 | 6/1995 | Schaeffer | 315/39.71 |

*Primary Examiner*—Benny T. Lee
*Attorney, Agent, or Firm*—Graham & James LLP

[57] ABSTRACT

A crossed-field device comprises a cathode having an electron emitting surface and an anode structure radially spaced from the cathode. The anode structure has a plurality of vanes extending in radial directions of the cathode with an interaction region defined between the electron emitting surface of the cathode and innermost radial ends of the anode vanes. First and second magnetic polepieces are respectively disposed at first and second axial ends of the cathode and have respective magnets coupled magnetically thereto. The polepieces direct magnetic flux from the respective magnets to define an axial magnetic field through the interaction region. The polepieces are electrically isolated from the anode structure. An anode modulator is adapted to provide a voltage potential between the anode structure and the cathode to define a radial electric field through the interaction region. A polepiece modulator is adapted to provide a voltage potential between the polepieces to define an axial electric field through the interaction region, whereby a frequency characteristic of the crossed-field device is adjusted by varying the axial electric field.

22 Claims, 4 Drawing Sheets

TERTIARY FIELD TUNING OF POSITIVE ANODE MAGNETRON

BACKGROUND OF THE INVENTION

1. Field of the Invention

The present invention relates to crossed-field devices such as magnetrons having a radial electric field and an axial magnetic field, and more particularly, to a positive anode magnetron in which a tertiary electric field is utilized to enable improved frequency tuning ability.

2. Description of Related Art

Magnetrons are a type of crossed-field device that is commonly used to generate high power microwave energy for assorted applications, such as radar. A magnetron typically comprises a cylindrically shaped cathode that extends axially along a central axis of an anode structure comprising a plurality of radially extending anode vanes. A space defined between the cathode surface and the tips of the anode vanes provides an interaction region, and an electric potential is applied between the cathode and the anode forming a radial electric field in the interaction region. An axial magnetic field is provided in a direction perpendicular to the electric field and is directed to the interaction region by polepieces which focus magnetic flux from permanent magnets disposed externally of the interaction region. The cathode may be provided with an internal heater disposed below the surface of the cathode to heat the cathode surface to a temperature sufficient to cause thermionic emission of electrons therefrom. The emitted electrons are caused to orbit around the cathode in the interaction region due to the axial magnetic field, during which they interact with an electromagnetic wave that is caused to move on the anode structure. The orbiting electrons give off energy to the electromagnetic wave, thus resulting in a high power microwave output signal.

In conventional magnetrons, the polepieces and the anode structure are disposed at the same electric potential relative to the cathode. The magnetron may be operated with negative voltage pulses being applied to the cathode with the anode grounded, or with positive pulses being applied to the anode with the cathode grounded. An advantage of such a magnetron structure is that the polepieces need not be isolated electrically from the anode, and thus, construction of the device is simplified. On the other hand, the potential difference between the cathode and the polepieces causes undesirable spreading, or defocusing, of the electron stream that extends between the cathode and the anode structure. As known in the art, the electron stream may be refocused to counteract the spreading phenomenon by tapering the polepieces to distort the magnetic field and by disposing end hats on the cathode to distort the electric field.

An alternative structure which tends to avoid the electron stream spreading phenomenon described above is known as the positive anode magnetron. In a positive anode magnetron, the cathode and the polepieces are disposed at the same electric potential relative to the anode. As a result, the electron stream remains focused as it passes between the cathode and the anode structure, thus eliminating the need to distort the magnetic field. An example of a positive anode magnetron is provided by U.S. Pat. No. 4,104,559, to Hobbs, for ISOPOLAR MAGNETRON SUPPORTED WITH RIGID INSULATION IN A REMOTE HOUSING.

A problem common to each of the known magnetron types is that of efficiently tuning the device to alter its operating frequency. There are three known methods of tuning a magnetron. A first method is to mechanically alter the resonant structure of the magnetron to alter its inductance or capacitance, and thereby change the output frequency. For example, the volume of the structure may be changed by a movable end plate or other such member. A significant drawback of this first method is that the response time of any such alterations is limited by the mechanical mass of the movable member which restricts the amount that the frequency of the magnetron can be changed during the period between successive pulses.

A second method of tuning a magnetron is to place electrically active devices within the resonant structure of the magnetron, such as pin diodes or multipactor discharge gaps. Such active devices are limited to non-linear tuning, and moreover, they increase the cost and complexity of manufacturing. For example, pin diodes are extremely fragile and prone to breakage during the manufacturing process, and they dissipate significant power when used in other than a switching mode for frequency modulations. Multipactor devices use secondary emission surfaces which require special processing techniques.

A third method of tuning a magnetron is to insert a tunable structure into the high electric field region of the resonant structure. For example, a mechanical gear arrangement may be used to control the position of a rotatable tuning element disposed within the interaction region. The tuning element may comprise a dielectric structure that alters the magnetron frequency in relation to its alignment with the electric field lines. A drawback of this third tuning method is that it is only effective with crossed-field devices having a low quality factor, Q, or the ratio of energy stored to energy lost due to dissipation, and thus is not practical with high power magnetrons.

Accordingly, it would be desirable to provide a system for tuning a high-power crossed-field device which overcomes these and other substantial drawbacks of the prior art tuning systems. In particular, it would be desirable to provide such an improved tuning system for use with a positive anode magnetron.

SUMMARY OF THE INVENTION

In accordance with the teachings of the present invention, a crossed-field device is provided which enables frequency tuning by modulating a tertiary electric field which extends axially through the interaction region of the crossed-field device.

The crossed-field device comprises a cathode having an electron emitting surface and an anode structure radially spaced from the cathode. The anode structure has a plurality of vanes extending in radial directions of the cathode with an interaction region defined between the electron emitting surface of the cathode and innermost radial ends of the anode vanes. First and second magnetic polepieces are respectively disposed at first and second axial ends of the cathode and have respective magnets coupled magnetically thereto. The polepieces direct magnetic flux from the respective magnets to define an axial magnetic field through the interaction region. The polepieces are electrically isolated from the anode structure. An anode modulator is adapted to provide a voltage potential between the anode structure and the cathode to define a radial electric field through the interaction region. A polepiece modulator is adapted to provide a voltage potential between the polepieces to define an axial electric field through the interaction region.

In an embodiment of the crossed-field device, the cathode is electrically isolated from the polepieces. The polepiece modulator is adapted to modulate distinct voltage levels onto each of the first and second polepieces. A frequency characteristic of the crossed-field device is adjusted by varying distinct voltage levels to thereby alter the axial electric field.

In an alternative embodiment of the crossed-field device, the cathode comprises a heater coil electrically coupled between from the polepieces, with a heater voltage supply adapted to provide a constant direct current voltage across the heater coil. The anode modulator is adapted to provide a positive voltage pulse to the anode structure, and the polepiece modulator is adapted to provide a negative voltage pulse to at least one of the first and second polepieces. The negative voltage pulse has a time duration which brackets a corresponding time duration of the positive voltage pulse. An isolation diode is coupled between the heater voltage supply and the polepiece modulator to prevent the negative voltage pulse from adversely affecting the heater voltage supply.

A more complete understanding of the tertiary field tuning of positive anode magnetron will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention satisfies the need for a system for tuning a high-power positive anode magnetron which overcomes the substantial drawbacks of the prior art tuning systems. In the detailed description that follows, it should be appreciated that like element numerals are used to describe like elements illustrated in one or more of the figures and may not be described in detail for all figures.

Figure 1:
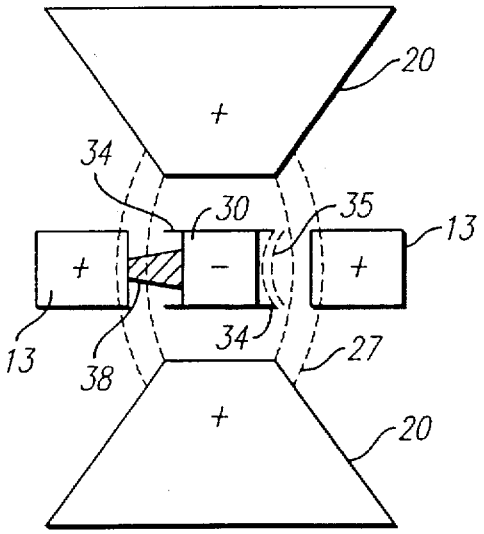
FIG. 1 PRIOR ART
FIG. 1 is a schematic drawing of an interaction region of a conventional magnetron illustrating the electric and magnetic field lines.

Referring first to FIG. 1, a schematic drawing of an interaction region of a conventional magnetron is illustrated. The magnetron includes a cathode 30 having end hats 34, a pair of polepieces 20 and a plurality of vanes 13. The cathode 30 is cylindrically shaped and has an electron emitting surface. The vanes 13 are generally rectangular, and extend in radial directions from the cathode 30. The polepieces 20 are disposed axially from the cathode 30 and have tapered side surfaces that reduce the width of the polepieces to a minimum adjacent to the cathode. The polepieces 20 are adapted to couple magnetic flux to the interaction region defined between the emitting surface of the cathode 30 and the innermost tips of the vanes 13.

In the conventional magnetron, the polepieces 20 are at the same positive electrical potential (+) as the anode vanes 13. The cathode 30 is at a negative electrical potential (−) with respect to the polepieces 20 and the anode vanes 13. The magnetic flux lines 27 extend between the two polepieces 20 passing through the interaction region. As illustrated in FIG. 1, the magnetic flux lines tend to become bowed outward about the cathode 30 due to the application of a direct current (DC) voltage between the polepieces 20 and the cathode. This bowing of the magnetic flux lines tends to spread the stream of electrons from the cathode 30 to the anode vanes 13. The end hats 34 on the ends of the cathode 30 distort the electric field between the cathode and the anode vanes 13, as illustrated by the electric field lines 35. Further, the tapering of the polepieces 20 distorts the magnetic field lines 27 to bring them closer to the cathode 30. These distortions of the electric and magnetic fields refocus the electron stream to approximate the desirable shape illustrated at 38 of FIG. 1.

Figure 2:
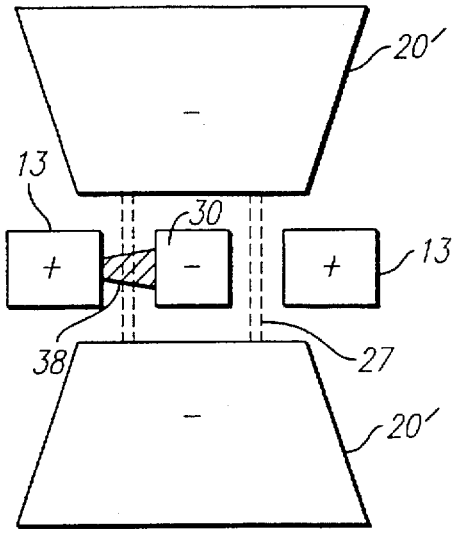
FIG. 2 PRIOR ART
FIG. 2 is a schematic drawing of an interaction region of a positive anode magnetron illustrating the electric and magnetic field lines.

In contrast, a schematic drawing of a positive anode magnetron is illustrated in FIG. 2. The positive anode magnetron includes the same fundamental elements of a cathode 30, anode vanes 13 and polepieces 20' as the conventional magnetron. Notably, the polepieces 20' have more moderate tapering of the side surfaces than the polepieces 20 of the conventional magnetron described above. The polepieces 20' are at the same negative electrical potential (−) as the cathode 30. The anode vanes 13 are at a positive electrical potential (+) with respect to the polepieces 20 and the cathode 30. The magnetic flux lines 27 extend directly between the two polepieces 20 passing through the interaction region without the bowing described above with respect to FIG. 1, due to the absence of DC voltage between the polepieces and the cathode 30. As a result, the stream of electrons from the cathode 30 to the anode vanes 13 maintains the focused shape illustrated at 38, without end hats on the cathode or the extreme tapering of the polepieces.

Figure 3:
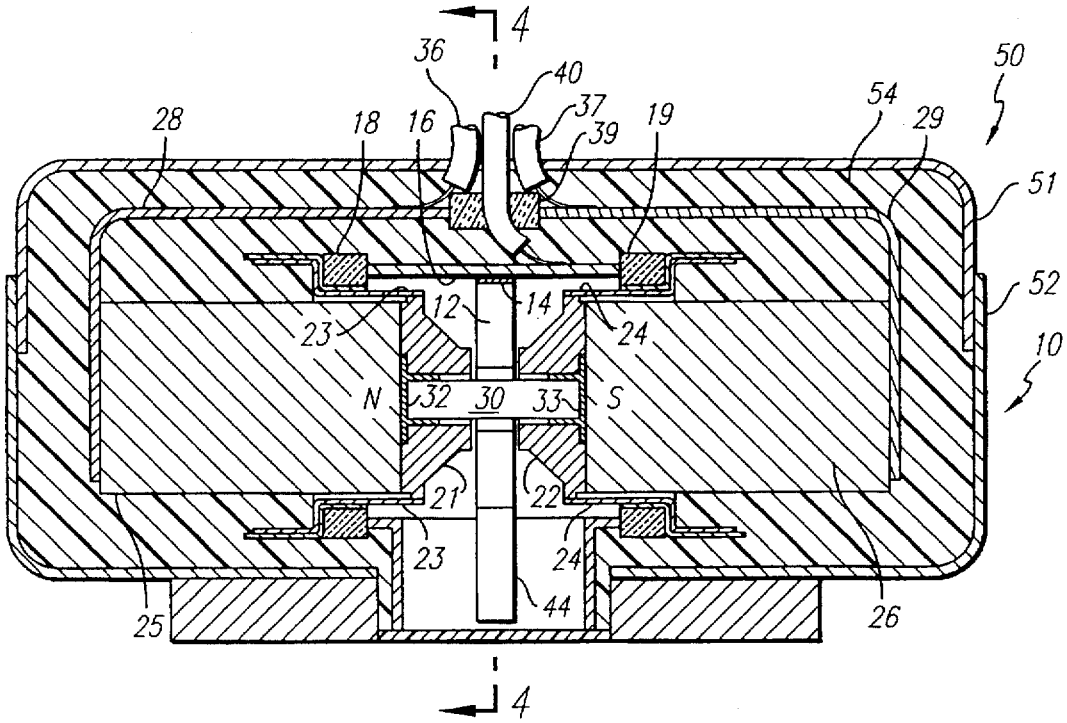
FIG. 3 is a side sectional view of a positive anode magnetron constructed in accordance with the present invention.
Figure 4:
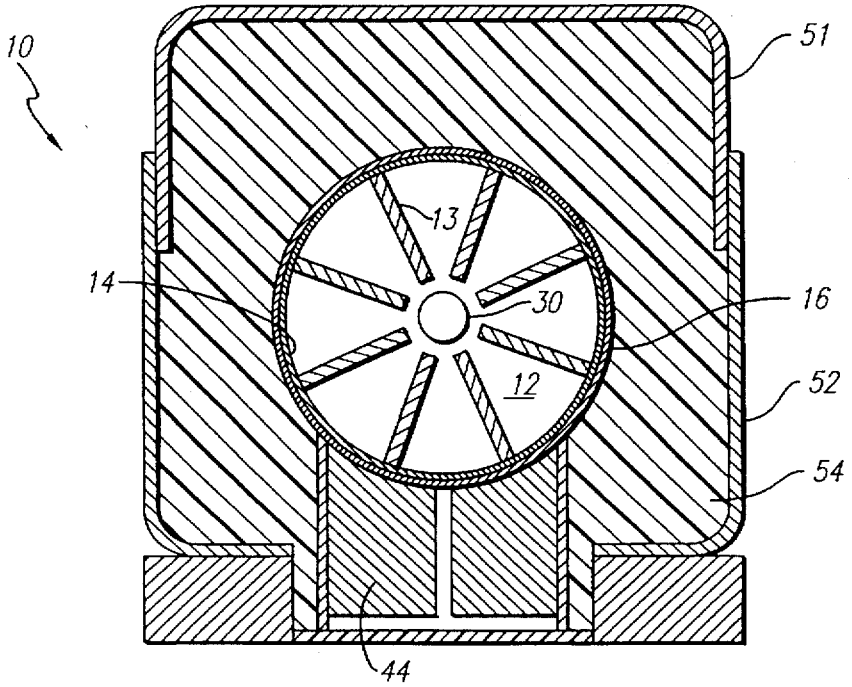
FIG. 4 is an end sectional view of the positive anode magnetron through the section 4—4 of FIG. 3.

Referring now to FIGS. 3 and 4, an exemplary embodiment of an interaction region of a positive anode magnetron 10 of the present invention is illustrated. The magnetron 10 is provided within a housing 50 having separate halves 51, 52, which may each be comprised of an electrically conductive material, such as copper. An anode structure 12 includes a plurality of vanes 13 extending radially inward from an outer ring 14 to an interaction region. The anode structure 12 is mounted within a tubular support 16 having a respective insulator 18, 19 affixed at each end (see FIG. 3). The insulators 18, 19 have an annular shape, and are comprised of an electrically insulating material capable of withstanding high voltages, such as ceramic. The anode support 16, vanes 13 and outer ring 14 are comprised of an electrically and thermally conductive material, such as copper. An RF output structure 44 is connected to the anode support 16, which provides for coupling of RF energy out of the magnetron 10.

As shown in FIG. 3, first and second magnetic polepieces 21, 22 having respective mounting sleeves 23, 24 are disposed concentrically within the anode support 16. The mounting sleeves 23, 24 are electrically insulated from the anode structure 12 by the insulators 18, 19, respectively. The polepieces 21, 22 are generally conical in shape, having a wide base portion that adjoins respective magnets 25, 26, and sides that taper inwardly to a reduced diameter surface adjacent to the vanes 13. The respective poles of the magnets 25, 26 are positioned to provide magnetic flux in the interaction region, with a north pole (N) coupled to the polepiece 21 and a south pole (S) coupled to the polepiece 22. The ends of the magnets 25, 26 that extend away from the polepieces mate with respective magnetic return straps 28, 29 which completes the magnetic circuit and provides for electrical connection to the polepieces 21, 22, as will be further described below. Though the magnets 25, 26 are illustrated as permanent magnets, it should be appreciated that electromagnets may also be advantageously utilized.

A cathode 30 is affixed at one end to the first polepiece 21 and at another end to the second polepiece 22 by respective mounting sleeves 32, 33 so that the cathode 30 extends along a central axis of the anode structure 12. Electrical leads 36, 37 are connected to the respective magnetic return straps 28, 29, so that the cathode and magnetic flux providing structures are thereby electrically connected together. An anode lead 40 is connected to the anode support 16. A cathode heater (described below) is disposed within the cathode 30, and has a separate electrical lead connected thereto. The magnetic return straps 28, 29 are isolated from each other by an insulator 39, and from the housing 50 by a solid insulating material 54, such as an epoxy cement which surrounds and rigidly supports the magnetron structure.

Figure 5:
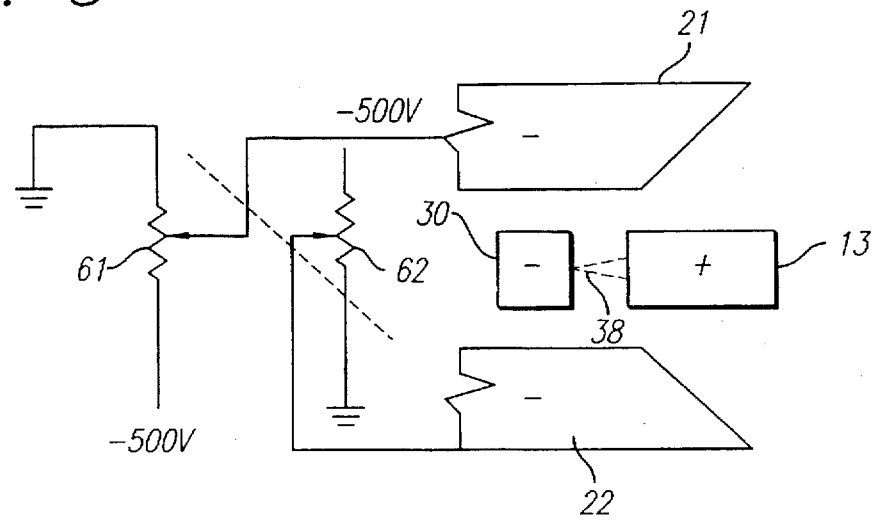
FIG. 5 is a schematic drawing of the interaction region of the positive anode magnetron of the present invention illustrating electrical connection of the polepieces to respective voltage sources.

A schematic drawing of the interaction region of the positive anode magnetron of the present invention is illustrated in FIG. 5. As in FIG. 2 described above, the schematic of FIG. 5 illustrates positive anode magnetron including a cathode 30, anode vanes 13 and polepieces 21, 22. The polepieces 21, 22 are electrically insulated from the anode vanes 13, and are coupled to respective voltage sources through respective variable resistors 61, 62, such as by use of electrical leads 36, 37 of FIG. 3. The variable resistors 61, 62 are adapted to vary in a diametrical manner, such that the potential applied to one of the polepieces 21, 22 increases as the other decreases. Accordingly, the potential between the two polepieces 21, 22 can be varied. FIG. 5 illustrates the voltage sources as being −500 volts, though it should be appreciated that other highly negative DC voltage values could be advantageously utilized.

In this invention, the potential between the two polepieces 21, 22 is used as a tertiary electric field to serve as a focusing element for the electron stream from the cathode 30 to the anode vanes 13. By varying the DC potential of the polepieces, the position of the electron steam as it contacts the innermost tips of the anode vanes 13 can be changed, thereby changing the frequency of the magnetron. This electron deflection principle is analogous to that experienced with cathode ray tubes, in which electrons are emitted by a cathode and focused into a finite stream. A negative potential applied to deflection plates of the cathode ray tube is used to repel and confine the electrons to a focused beam. Varying the differential voltage applied between the deflection plates causes a proportional deflection of the beam from its axis of focus. If the polepieces 21, 22 of the positive anode magnetron are visualized as the deflection plates in a cathode ray tube, it can be appreciated that the electron stream can be deflected upward and downward. For example, the electron stream 38 is shown in FIG. 5 as striking a central portion of the tip of vane 13, but by varying the potential between the polepieces 21, 22 the electron stream could be repositioned either up or down the vane tip. Changing the position of the electron stream as it strikes the vane tip will alter the frequency of the magnetron. Thus, the positive anode magnetron is a crossed-field device having a radial electric field, an axial magnetic field, and an axial electric field.

Figure 6:
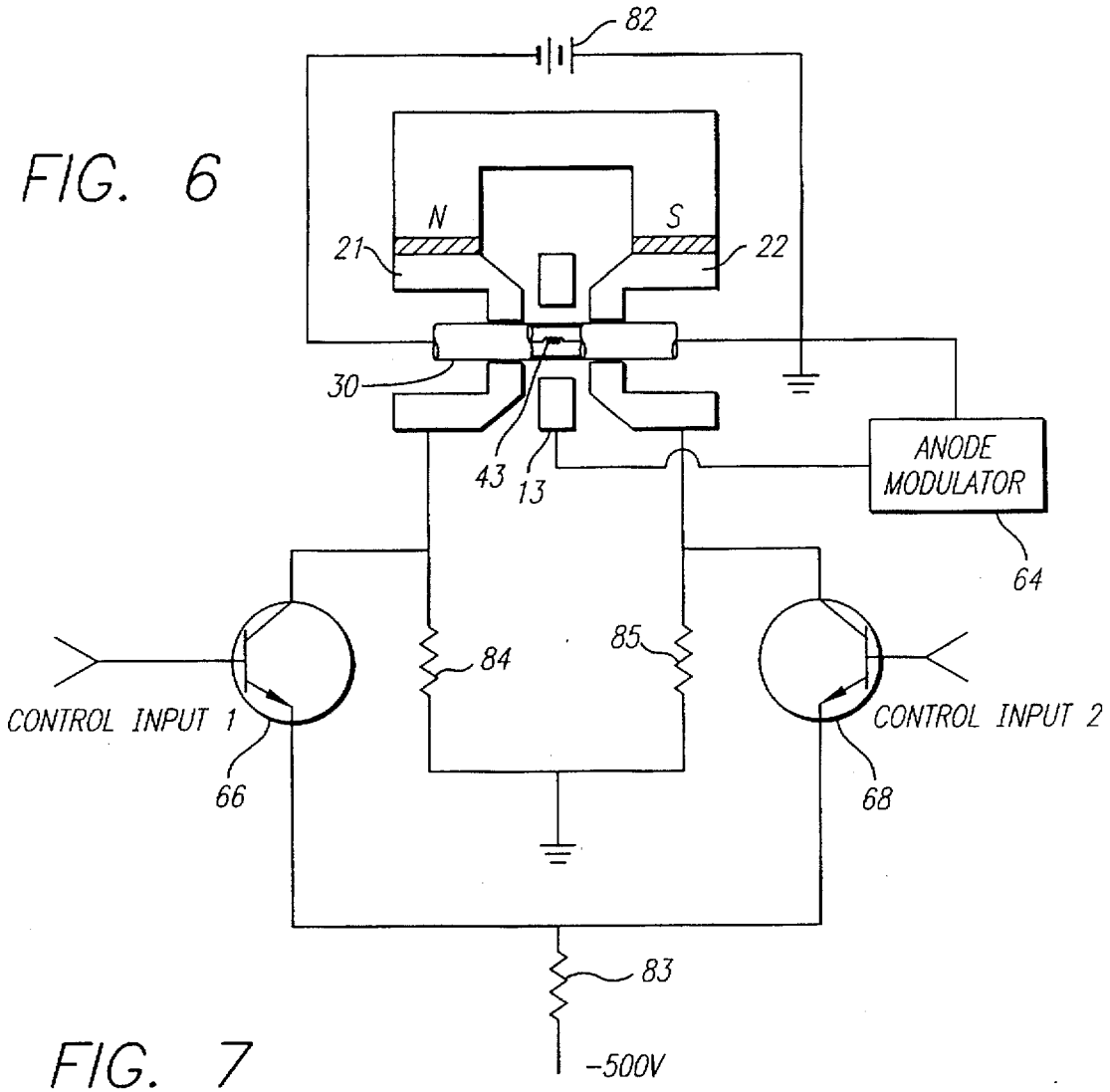
FIG. 6 is a schematic drawing of an alternative embodiment of the interaction region of the positive anode magnetron.

FIG. 6 illustrates an embodiment of the positive anode magnetron utilizing a tertiary electric field for electron stream focusing. In the embodiment of FIG. 6, a cathode heater coil 43 is embedded within the cathode 30 in a manner which is isolated electrically from the polepieces 21, 22. A heater voltage supply 82 is coupled to a first end of the heater coil 43, with the other end of the heater coil coupled to ground. The heater voltage supply 82 provides a constant DC voltage to the heater coil 43, such as 12 volts with the heater coil drawing approximately ¼ ampere. As known in the art, the heater coil 43 raises the temperature of the cathode 30 to facilitate thermionic emission of electrons therefrom. An anode modulator 64 is coupled to the anode vanes 13 to provide a positive voltage thereto. As known in the art, the anode modulator provides a peak positive voltage to the anode vanes 13, such as 2 kilovolts, either in the form of distinct pulses or as a continuous wave (CW).

The polepieces 21, 22 are coupled to collectors of modulation transistors 66, 68, respectively. The modulation transistors 66, 68 are of the NPN-type, and are selected to withstand high voltage potentials between the respective collector and emitter terminals. The emitter terminals of the modulation transistors 66, 68 are each coupled to a negative voltage source, such as −500 volts, through a resistor 83. The polepieces 21, 22 are also coupled to ground through respective resistors 84, 85. The base terminals of the modulation transistors 66, 68 are coupled to control inputs 1 and 2, respectively, which modulate the potentials applied to the respective polepieces 21, 22.

By modulating the potential between the polepieces 21, 22 in synchronism with the modulation of the anode vanes 13 by the anode modulator 64, the electron stream can be focused to tune the operating frequency of the magnetron. Since the heater coil 43 is isolated from the polepieces 21, 22, there is no current drawn from the polepieces into the heater coil. It is anticipated that this embodiment would permit extremely wide bandwidth for a positive anode magnetron on the order of 5 MHz deviation, and would permit frequency deviation during the anode pulses. Positive anode magnetron applications made feasible by this embodiment would include pulse compression and coherent radar.

Figure 7:
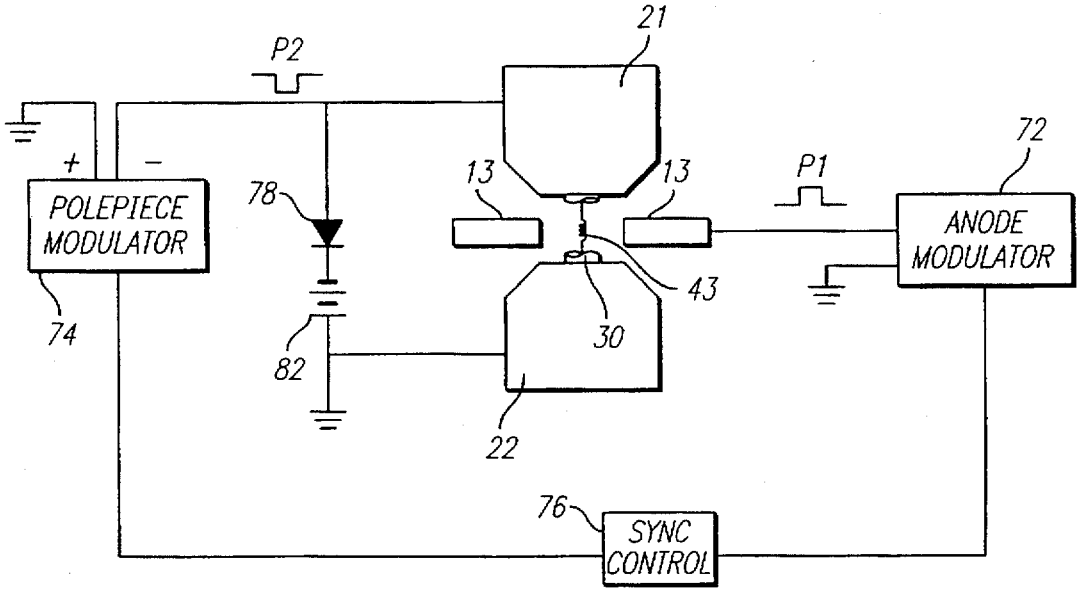
FIG. 7 is a schematic drawing of another alternative embodiment of the interaction region of the positive anode magnetron.

FIG. 7 illustrates another embodiment of the positive anode magnetron utilizing a tertiary electric field for electron stream focusing. In the embodiment of FIG. 7, the cathode heater coil 43 embedded within the cathode 30 is coupled between the polepieces 21, 22. Unlike the previous embodiment, it is necessary to alter the potential across the polepieces 21, 22 without affecting the voltage applied to the heater coil 43. A heater voltage supply 82 is coupled to a first end of the heater coil 43 through the polepiece 21. A polepiece modulator 74 is coupled to the other end of the heater coil 43 through the polepiece 22. An isolation diode 78 is coupled between the polepiece modulator 74 and the heater voltage supply 82 to isolate the heater voltage supply from the polepiece modulator. As in the embodiment of FIG. 6, an anode modulator 72 is coupled to the anode vanes 13. A sync control device 76 is coupled to each of the polepiece modulator 74 and the anode modulator 72.

Figure 8:
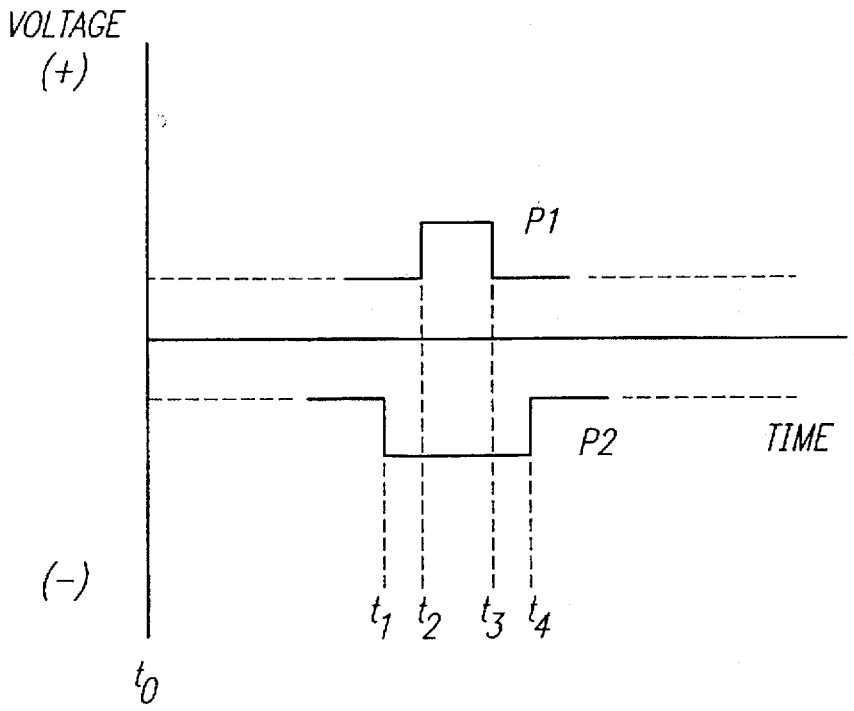
FIG. 8 is a graph illustrating the timing of modulation pulses provided to an anode and a polepiece of the positive anode magnetron of FIG. 7.

FIG. 8 is a graph illustrating the timing of modulation pulses provided to an anode and a polepiece of the positive anode magnetron of FIG. 7, in which values above the horizontal axis are positive (+) voltages and values below the horizontal axis are negative (−) voltages. The anode modulator provides positive voltage pulses (P1) to the anode vanes 13, such as 2 kilovolts. The polepiece modulator 74 provides negative voltage pulses (P2) to the polepiece 21, in which the negative pulses P2 have a pulse width greater than the positive pulses P1 so that the positive pulses are entirely bracketed by the negative pulses, as illustrated in FIG. 8. Particularly, the negative pulses P2 have a pulse width of approximately 10 microseconds and extend from time $t_1$, to $t_4$ while the positive pulses P1 have a pulse width of approximately 5 microseconds and extend from time $t_2$ to $t_3$. It is anticipated that this embodiment would permit maximum frequency deviation of 700 KHz for a positive anode magnetron, or 3 KHz/volt of applied potential to the polepieces, using a −250 volt tuning pulse.

Having thus described a preferred embodiment of a positive anode magnetron having tertiary field tuning, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. A crossed-field device comprises:

a cathode having an electron emitting surface;

an anode structure radially spaced from said cathode and having a plurality of vanes extending in radial directions relative to said cathode with an interaction region defined between said electron emitting surface of said cathode and innermost radial ends of said anode vanes;

a pair of magnetic polepieces respectively disposed at opposite axial ends of said cathode and having respective corresponding magnets coupled magnetically thereto, said pair of polepieces directing magnetic flux from said respective corresponding magnets to define an axial magnetic field through said interaction region, said pair of polepieces being electrically isolated from said anode structure;

first means for providing a first voltage potential between said anode structure and said cathode to define a radial electric field through said interaction region; and second means for providing a second voltage potential between said polepieces to define an axial electric field through said interaction region.

2. The crossed-field device of claim 1, wherein said first means for providing a first voltage potential further comprises an anode pulse modulator.

3. The crossed-field device of claim 1, wherein said second means for providing a second voltage potential further comprises a polepiece pulse modulator.

4. The crossed-field device of claim 1, wherein said cathode is electrically isolated from said pair of polepieces.

5. The crossed-field device of claim 4, wherein said second means for providing a second voltage potential further comprises means for modulating distinct voltage levels on each respective one of said pair of polepieces.

6. The crossed-field device of claim 1, wherein said cathode further comprises a heater coil electrically coupled between said pair of polepieces, and further comprising a heater voltage supply providing a constant direct current voltage across said heater coil.

7. The crossed-field device of claim 6, wherein said first means for providing a first voltage potential provides a positive voltage pulse to said anode structure, and said second means for providing a second voltage potential provides a negative voltage pulse to one of said pair of polepieces.

8. The crossed-field device of claim 7, wherein said negative voltage pulse has a time duration which brackets a corresponding time duration of said positive voltage pulse.

9. The crossed-field device of claim 6, further comprising an isolation diode coupled between said heater voltage supply and said second means for providing a second voltage potential.

10. The crossed-field device of claim 1, wherein a frequency characteristic of said crossed-field device is controlled by said second voltage potential.

11. A crossed-field device comprises:

a cathode having an electron emitting surface;

an anode structure radially spaced from said cathode and having a plurality of vanes extending in radial directions relative to said cathode with an interaction region defined between said electron emitting surface of said cathode and innermost radial ends of said anode vanes;

first and second magnetic polepieces respectively disposed at first and second axial ends of said cathode and having corresponding magnets coupled magnetically thereto, said first and second polepieces directing magnetic flux from said corresponding magnets to define an axial magnetic field through said interaction region, said first and second polepieces being electrically isolated from said anode structure;

an anode modulator providing a voltage potential between said anode structure and said cathode to define a radial electric field through said interaction region; and a polepiece modulator providing a voltage potential between said first and second polepieces to define an axial electric field through said interaction region, whereby a frequency characteristic of said crossed-field device is adjusted by varying said axial electric field.

12. The crossed-field device of claim 11, wherein said cathode is electrically isolated from said first and second polepieces.

13. The crossed-field device of claim 11, wherein said polepiece modulator modulates distinct voltage levels onto each of said first and second polepieces.

14. The crossed-field device of claim 11, wherein said cathode further comprises a heater coil electrically coupled between said first and second polepieces, and further comprising a heater voltage supply providing a constant direct current voltage across said heater coil.

15. The crossed-field device of claim 14, further comprising an isolation diode coupled between said heater voltage supply and said polepiece modulator.

16. The crossed-field device of claim 11, wherein said anode modulator provides a positive voltage pulse to said anode structure, and said polepiece modulator provides a negative voltage pulse to at least one of said first and second polepieces.

17. The crossed-field device of claim 16, wherein said negative voltage pulse has a time duration which brackets a corresponding time duration of said positive voltage pulse.

18. The crossed-field device of claim 11, wherein the crossed-field device further comprises a positive anode magnetron.

19. A crossed-field device comprises:

a cathode having an electron emitting surface;

an anode radially spaced from said cathode such that an interaction region is defined between said electron emitting surface of said cathode and said anode;

first and second magnetic polepieces respectively disposed at first and second axial ends of said cathode and having corresponding magnets coupled magnetically thereto, said first and second polepieces directing magnetic flux from said corresponding magnets to define an axial magnetic field through said interaction region, said first and second polepieces being electrically isolated from said anode;

a first voltage source providing a voltage potential between said anode and said cathode to define a radial electric field through said interaction region; and a second voltage source providing a voltage potential between said first and second polepieces to define an axial electric field through said interaction region, whereby a frequency characteristic of said crossed-field device is adjusted by varying said axial electric field.

20. The crossed-field device of claim 19, wherein said second voltage source modulator modulates distinct voltage levels onto each of said first and second polepieces.

21. The crossed-field device of claim 19, wherein said first voltage source provides a positive voltage pulse to said anode, and said second voltage source provides a negative voltage pulse to at least one of said first and second polepieces.

22. The crossed-field device of claim 19, wherein said negative voltage pulse has a time duration which brackets a corresponding time duration of said positive voltage pulse.

* * * * *